US007261384B1

(12) United States Patent
Craft, Jr. et al.

(10) Patent No.: US 7,261,384 B1
(45) Date of Patent: Aug. 28, 2007

(54) ARMOIRE

(76) Inventors: Lester R. Craft, Jr., 2026 Veteran Ave., Los Angeles, CA (US) 90025; Stacey M. Craft, 2026 Veteran Ave., Los Angeles, CA (US) 90025

( * ) Notice: Subject to any disclaimer, the term of this patent is extended or adjusted under 35 U.S.C. 154(b) by 167 days.

(21) Appl. No.: 10/982,322

(22) Filed: Nov. 5, 2004

(51) Int. Cl.
*A47B 81/00* (2006.01)

(52) U.S. Cl. ..... 312/235.3; 312/224; 312/240; 312/290

(58) Field of Classification Search ..... 312/107, 312/108, 109, 203, 224, 235.2, 235.3, 240, 312/326, 329, 196, 195, 209, 321.5, 290, 312/249.9, 249.11
See application file for complete search history.

(56) References Cited

U.S. PATENT DOCUMENTS

| | | | | | |
|---|---|---|---|---|---|
| 122,337 | A | * | 1/1872 | Thompson | 312/224 |
| 414,309 | A | * | 11/1889 | Hardie | 312/235.2 |
| 1,133,866 | A | * | 3/1915 | Leighty | 312/240 |
| 1,690,404 | A | * | 11/1928 | Dieckmann | 312/204 |
| 1,798,800 | A | * | 3/1931 | Hector | 312/198 |
| 1,844,572 | A | * | 2/1932 | Gourley et al. | 361/608 |
| 1,952,216 | A | * | 3/1934 | Dudley | 312/235.2 |
| 1,994,405 | A | * | 3/1935 | Sayres | 192/116.5 |
| 2,004,896 | A | * | 6/1935 | Albert | 312/235.3 |
| 2,059,994 | A | * | 11/1936 | Charles | 312/277 |
| D154,453 | S | * | 7/1949 | Schukat | D6/338 |
| D159,534 | S | * | 8/1950 | Raichert | D6/338 |
| 2,614,018 | A | * | 10/1952 | Walter | 297/147 |
| 2,628,879 | A | * | 2/1953 | Schultz | 312/235.5 |
| 2,665,963 | A | * | 1/1954 | Sanford | 312/235.3 |
| 2,703,743 | A | * | 3/1955 | Harwood | 312/128 |
| 3,353,865 | A | * | 11/1967 | Sidney | 297/143 |
| 3,712,667 | A | * | 1/1973 | Weber | 297/140 |
| 4,026,616 | A | * | 5/1977 | Kuehl | 312/249.9 |
| 4,736,998 | A | | 4/1988 | Wilson et al. | 312/235 |
| 5,547,270 | A | | 8/1996 | Dang | 312/194 |
| 5,558,418 | A | | 9/1996 | Lambright et al. | 312/321.5 |
| 5,584,548 | A | | 12/1996 | Miller | 312/235.3 |
| 5,678,905 | A | * | 10/1997 | Kelley | 312/196 |
| 5,803,562 | A | | 9/1998 | Jacobs et al. | 312/283 |
| 5,927,833 | A | | 7/1999 | Kelley | 312/196 |
| 5,996,272 | A | | 12/1999 | Raff | 43/54.1 |
| 6,053,588 | A | | 4/2000 | Biggel et al. | 312/249.8 |
| 2003/0146678 | A1 | * | 8/2003 | Greiner | 312/107 |

* cited by examiner

*Primary Examiner*—Janet M. Wilkens

(57) ABSTRACT

The armoire includes a concealed, removable bench containing two drawers. In use the bench is removed for seating purposes and the doors of the armoire are opened. A shelf is provided for various tasks such as for use as a make-up counter. A mirror on the inside of the upper section is equipped with lights. Shelves and other accessories contained within the upper section provide convenience for the user. When the armoire is dormant the bench is contained therein with the front of the bench flush with the housing to provide a normal appearance for the armoire.

18 Claims, 5 Drawing Sheets

ARMOIRE

FIELD OF THE INVENTION

The invention herein pertains to armoires and particularly pertains to an armoire having a removable bench contained within its lower section.

DESCRIPTION OF THE PRIOR ART AND OBJECTIVES OF THE INVENTION

With the floor space of houses, apartments and other dwellings being in greater demand in recent years, the need for additional dressing and personal cosmetic areas, bathrooms, closets and the like has increased. Further, the addition of a room or the remodeling of interior space is often not feasible or practical. Dwellers in rented houses and apartments are often forbidden from making structural changes to meet their specific, desired requirements. Of particular inconvenience is a situation in which two (2) or more people dressing or attending to cosmetic needs simultaneously use a single bathroom.

Thus in view of the problems and disadvantages of smaller, conventional living areas, the present invention was conceived and one of its objectives is to provide an armoire which appears as conventional while closed, yet which will provide the home or building occupants with additional dressing and personal cosmetic space when opened.

It is another objective of the present invention to provide a decorative armoire which can be easily opened for use as a dressing and vanity area.

It is still another objective of the present invention to provide an armoire having an upper section which can be opened and illuminated for vanity purposes.

It is a further objective of the present invention to provide an armoire having a lower section with a removable wheeled bench for seating while using a hair dryer, applying make-up or the like.

Various other objectives and advantages of the present invention will become apparent to those skilled in the art as a more detailed description is set forth below.

SUMMARY OF THE INVENTION

The aforesaid and other objectives are realized by providing a decorative armoire of conventional portions and appearance having a concealed bench therein. The armoire includes an upper section having two (2) bi-foldable doors which open to expose a mirror mounted on the rear interior wall of the upper section. A dressing table or shelf forms the bottom of the upper section. The lower section below the shelf includes a cavity formed by the housing walls which contain a removable bench. The front of the bench is flush or co-planar with the outer housing such that the front outer surface of the bench is coplanar with the front of the lower section when the bench is not in use and is positioned therein. Thus, when the armoire is in a dormant position it appears as a usual armoire. In use, its appearance greatly changes as the bench is removed from the lower section for seating and the upper section doors open to expose a vanity area.

The armoire can be positioned in a hallway or other suitable location within a dwelling where it remains ready to serve the occupants.

DETAILED DESCRIPTION OF THE PREFERRED EMBODIMENT AND OPERATION OF THE INVENTION

Figure 1:
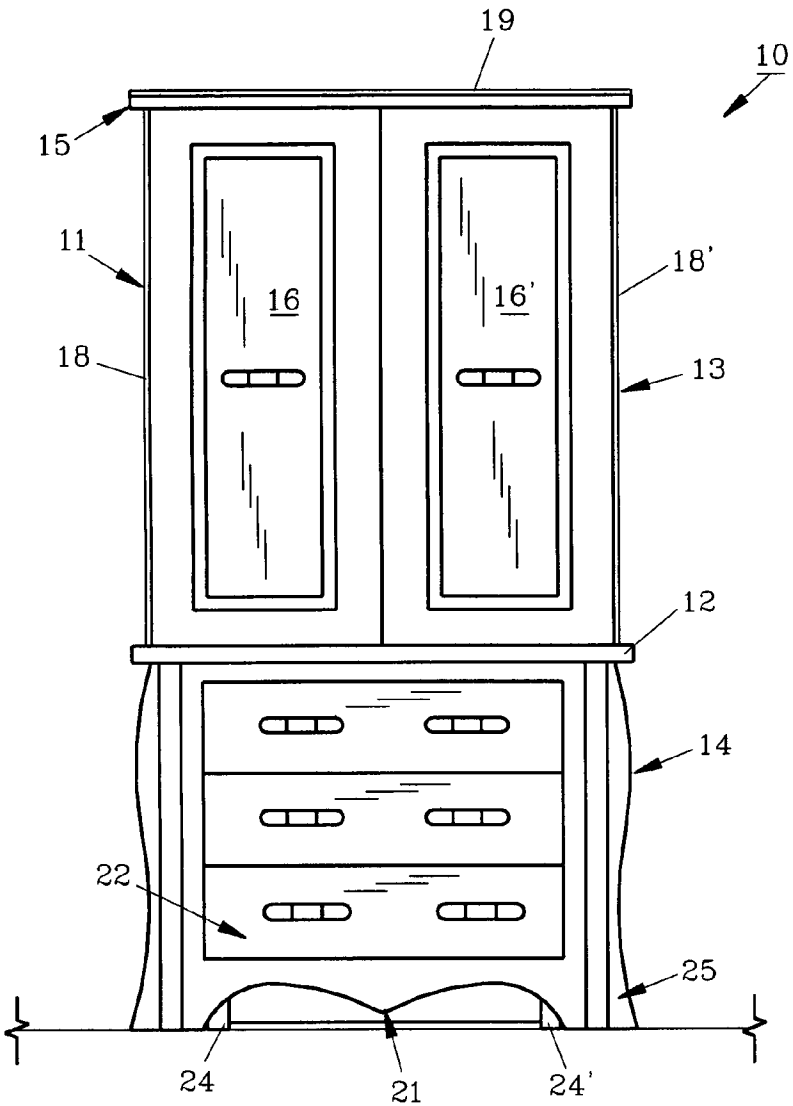
FIG. 1 shows a front elevational view of the preferred armoire of the invention with the bench positioned therein.
Figure 2:
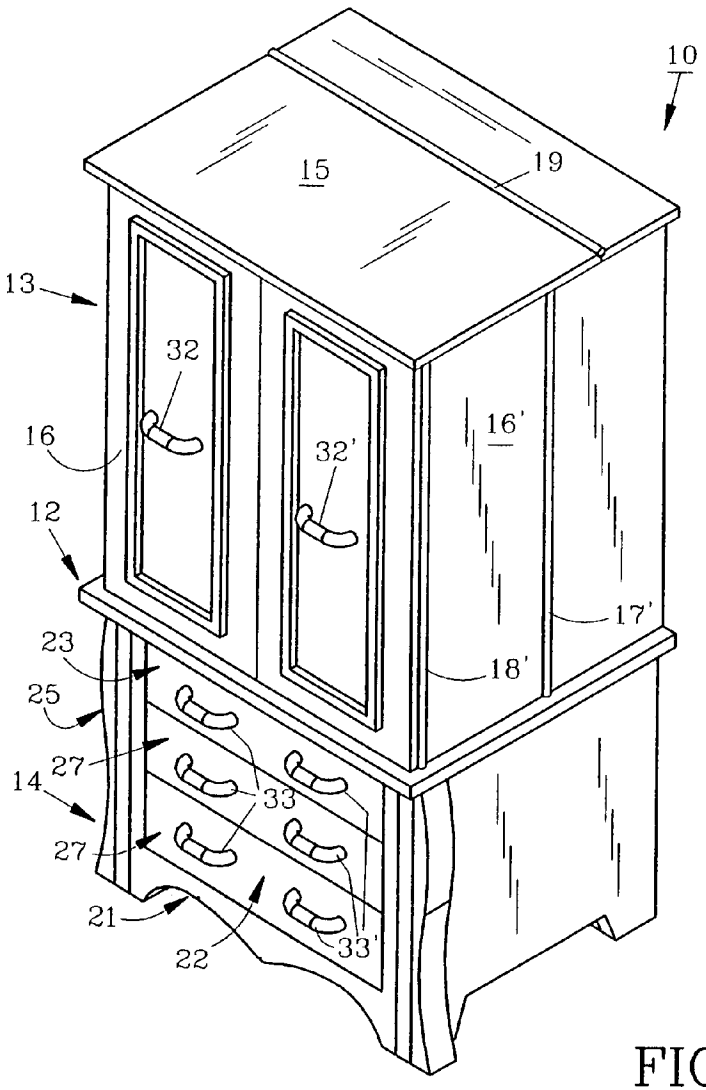
FIG. 2 features a front perspective view of the armoire as seen in FIG. 1.
Figure 6:
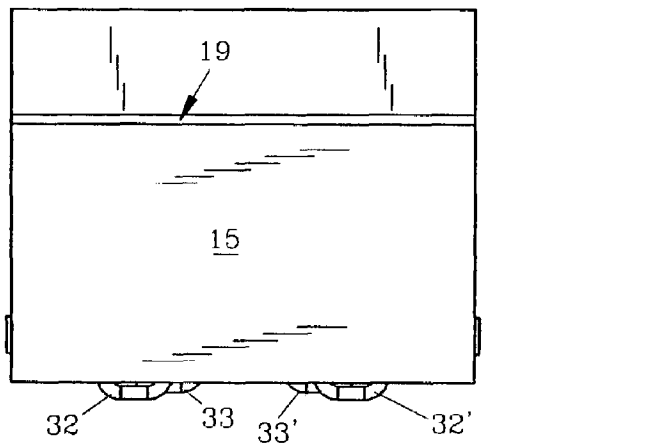
FIG. 6 pictures a top view of the armoire but with the doors and top closed.

For a better understanding of the invention and its operation, turning now to the drawings, FIG. 1 illustrates a front view of preferred armoire 10 which includes an outer housing 11 divided by shelf 12 into upper section 13 and lower section 14. Housing 11 includes top 15 which is hingedly attached to upper section 13 along with left bi-foldable door 16, having hinges 17, 18 (FIGS. 3 and 4) and right bi-foldable door 16', with hinges 17', 18' (FIGS. 3 and 4) as shown in FIGS. 1 and 2. As shown in FIGS. 2, 4 and 6 doors 16, 16' include elongated handles 32, 32' respectively.

Figure 3:
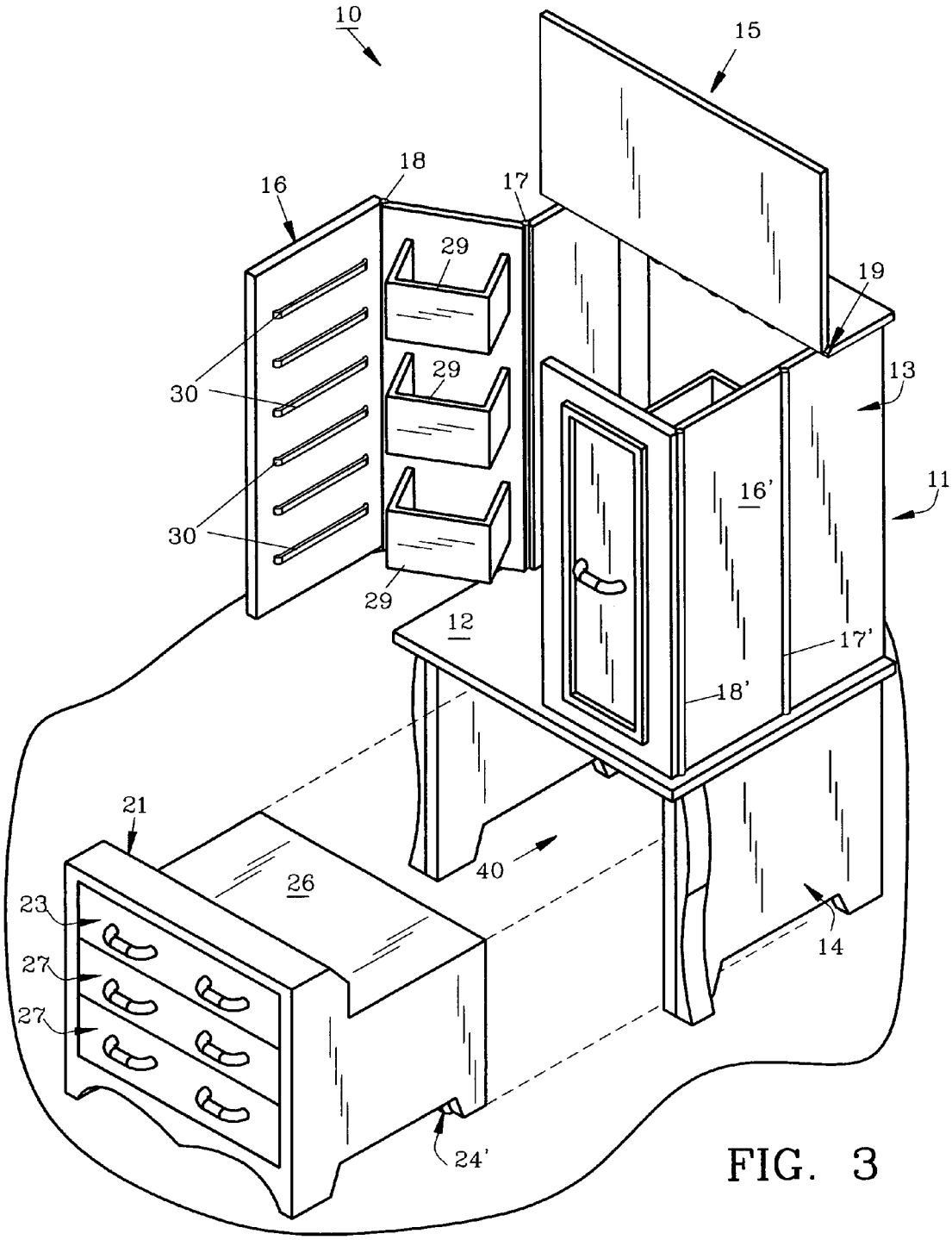
FIG. 3 demonstrates a front perspective view of the armoire as shown in FIG. 1 but with the top and left door open and the bench removed.
Figure 4:
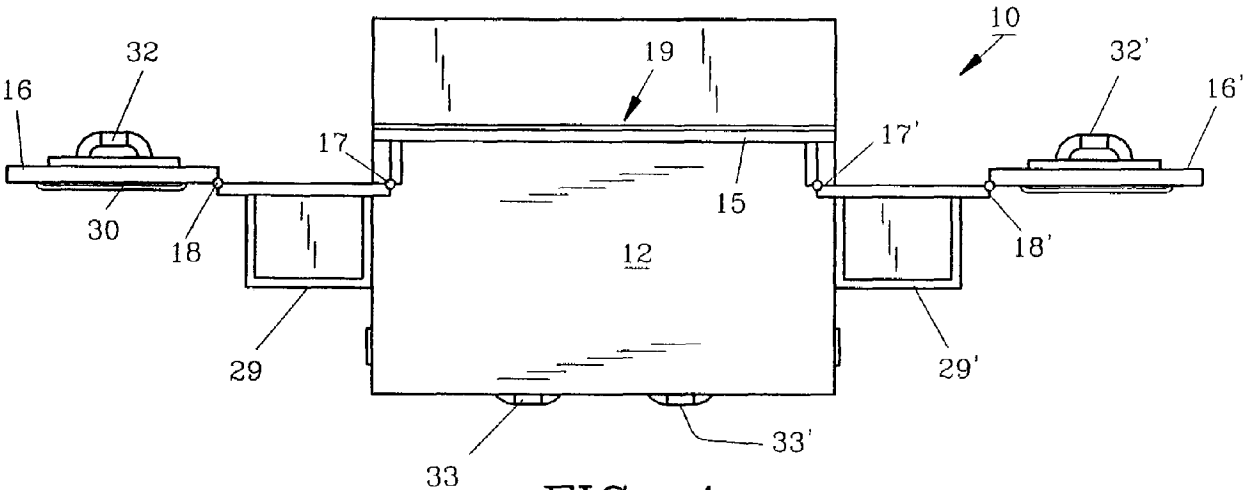
FIG. 4 illustrates a top view of the armoire with both bi-foldable doors open and the top raised as in FIG. 3.

In FIG. 3, armoire 10 is shown with door 16 open while door 16' remains in a closed posture. Top 15 is raised in FIG. 3 from its closed position as seen in FIGS. 1, 2 and 6. Top hinge 19 allows top 15 to pivot near the back of cabinet upper section 13 as seen in FIG. 4. As further shown in FIG. 3, housing 11 forms cavity 40 for containing bench 21 in lower section 14. Bench 21 includes wheels 24, 24' as shown in FIG. 1 which assist in removing bench 21 from housing 11 for seating purposes. As also seen in FIGS. 1 and 2, front 22 of bench 21 is substantially coplanar with face 25 of lower section 14 when bench 21 is inserted into lower section 14 of housing 11. Front 22 includes a false drawer front 23 and two (2) drawer fronts 27 of actual pull type drawers, as seen in FIG. 3. As seen in FIGS. 2, 4 and 6 handles 33, 33' are also elongated and are positioned horizontally on drawer fronts 23, 27 and 27. Drawer front 23 is not openable as a drawer, as are drawer fronts 27 which are real and are attached to drawers (not shown) within bench 21. Drawers or shelves (not shown) may also be located on the inside of the bench opposite the exterior drawer fronts 27. Bench 21 can be grasped by handles 33, 33' on fake drawer front 23 and pulled outwardly when needed for seating. For comfort, bench 21 includes seat cushion 26 (FIG. 3) which may consist of foam rubber covered with a suitable fabric or other material.

Figure 5:
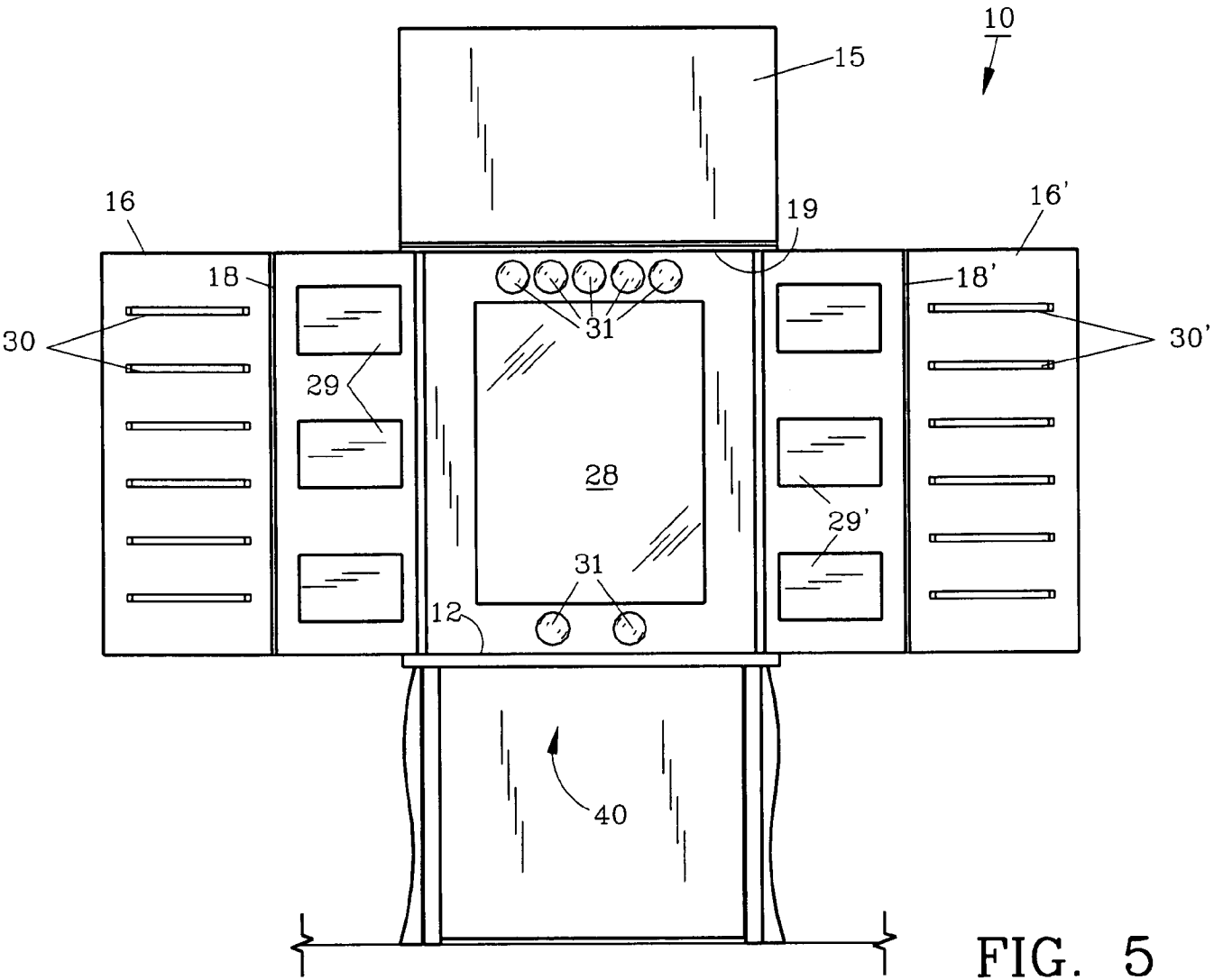
FIG. 5 depicts a front elevational view of the armoire with the left door, right door and top open and with the bench removed therefrom.

The inside of upper section 13 can be designed and decorated as desired and is shown herein preferably configured as a vanity area with various storage compartments for placing and storing personal beauty items (not seen) therein. Mirror 28 seen in FIG. 5 with lights 31 allow armoire 10 to be used as a convenient dressing and make-up area. Various door mounted containers 29, 29' seen in FIGS. 3 and 5 allow cosmetics and the like to be stored whereas elastic straps 30, 30' provide containing means for hair dryers and other personal grooming equipment. Straps 30, 30' are affixed to bi-foldable doors 16, 16' by staples or other fasteners as would be understood, by those in the cabinet industry. Various types of storage brackets or the like can also be included in upper section 13 as desired for particular grooming needs.

The illustrations and examples provided herein are for explanatory purposes and are not intended to limit the scope of the appended claims.

We claim:

1. An armoire comprising:

a) a housing, said housing defining an upper and a lower section;

b) a pair of doors, said doors attached to said upper section;

c) a removable bench, said bench comprising a trio of drawer fronts, one of said drawer fronts forming part of an openable drawer and the uppermost of said drawer fronts representing a fake drawer, said drawer fronts and said doors being coplanar in a closed position with said bench contained within said lower section; and d) a dressing shelf, said dressing shelf positioned between said upper and said lower sections.

2. The armoire of claim 1 further comprising a wheel, said wheel affixed to said bench for rolling the same.

3. The armoire of claim 1 further comprising a seat, said seat affixed to said bench, said seat comprising a cushion, said cushion proximate a drawer front.

4. The armoire of claim 1 further comprising a top, said top hingedly attached to said upper section.

5. The armoire of claim 1 wherein said drawer fronts are elongated horizontally in parallel relation.

6. The armoire of claim 1 wherein said pair of doors are bi-foldable, a pair of elongated handles, each of said pair of handles positioned on different ones of said pair of bi-foldable doors.

7. The armoire of claim 1 wherein said upper section includes a mirror, said mirror contained within said upper section.

8. The armoire of claim 7 further comprising a light, said light positioned in said upper section above said mirror.

9. The armoire of claim 1 wherein each of said drawer fronts comprises a pair of handles, each of said pair of handles longitudinally positioned horizontally on said drawer fronts.

10. An armoire comprising:

a) a housing, said housing defining an upper and a lower section;

b) a pair of doors, said doors attached to said upper section;

c) a removable bench, said bench fitting within said lower section;

d) a pair of openable drawers, said openable drawers contained within said bench;

e) a plurality of drawer fronts, one of said drawer fronts forming part of one of said openable drawers and another of said drawer fronts representing a drawer, said drawer fronts and said doors being coplanar in a closed position with said bench contained within said lower section; and f) a dressing shelf, said dressing shelf positioned between said upper and said lower sections.

11. The armoire of claim 10 further comprising a mirror, said mirror positioned within said upper section.

12. The armoire of claim 11 further comprising a light, said light positioned in said upper section above said mirror.

13. The armoire of claim 10 wherein said doors are bi-foldable.

14. The armoire of claim 10 further comprising a wheel, said wheel affixed to said bench for rolling the same.

15. The armoire of claim 10 further comprising a top, said top hingedly connected to said upper section.

16. The armoire of claim 10 further comprising a seat, said seat affixed to said bench, said seat comprising a cushion, said cushion proximate a drawer front.

17. The armoire of claim 10 wherein each of said plurality of drawer fronts are elongated horizontally in parallel relation.

18. The armoire of claim 10 wherein each of said plurality of drawer fronts comprises a pair of handles, each of said pair of handles longitudinally positioned horizontally on said drawer fronts.

* * * * *